United States Patent [19]

Bergersen

[11] Patent Number: 4,665,302

[45] Date of Patent: May 12, 1987

[54] ELECTRICAL HEATING ELEMENT

[75] Inventor: Hans A. Bergersen, Oslo, Norway

[73] Assignee: Standard Telefon OG Kabelfabrik A/S, Norway

[21] Appl. No.: 774,106

[22] Filed: Sep. 9, 1985

[30] Foreign Application Priority Data

Sep. 10, 1984 [NO] Norway ..... 843580

[51] Int. Cl.[4] ..... H01R 13/48

[52] U.S. Cl. ..... 219/212; 219/541

[58] Field of Search ..... 219/541, 528, 529, 548, 219/549, 512; 174/92; 339/206 R, 206 P, 91 R, 103, 198 R, 198 H, 208, 103 B, 107, 95 D, 204, 205

[56] References Cited

U.S. PATENT DOCUMENTS

| | | | |
|---|---|---|---|
| 2,696,549 | 12/1954 | Sturtevant | 219/212 |
| 3,440,408 | 4/1969 | Brittan | 219/345 |
| 4,108,527 | 8/1978 | Douty et al. | 339/206 |
| 4,210,380 | 7/1980 | Brzostek | 339/107 |
| 4,354,886 | 10/1982 | Bergersen | 156/50 |
| 4,363,947 | 12/1982 | Bergersen | 219/528 |
| 4,435,612 | 3/1984 | Smith | 174/92 |
| 4,437,725 | 3/1984 | Eaby et al. | 339/205 |
| 4,501,956 | 2/1985 | Bergersen | 219/553 |
| 4,585,922 | 4/1986 | Berenson | 219/212 |

OTHER PUBLICATIONS

Pending patent application Ser. No. 749,348, filed Jun. 27, 1985, Inventor: H. A. Bergersen, Entitled: "*Electrical Heating Foil Element*".

*Primary Examiner*—M. Jordan

*Attorney, Agent, or Firm*—John T. O'Halloran; Mary C. Werner

[57] ABSTRACT

An electrical foil heating element has a terminal box attached directly to the element. Power leads may be connected to the heating element after it has been installed through sockets in the box. The terminal box is also provided with screwless contacts or push wire connectors.

7 Claims, 8 Drawing Figures

ELECTRICAL HEATING ELEMENT

BACKGROUND OF THE INVENTION

The present invention relates to electrical heating elements and in particular to laminated heating elements of the type described in U.S. Pat. No. 3,262,307 (Lund et al). Whereas such heating elements are of the laminated foil type having a strip of electrical resistance material arranged in a predetermined pattern between sheaths of insulation material, a problem usually arises when the rather delicate foil heating element is to be interconnected with rather rigid power supply leads.

For many years it has been common practice to connect power leads as integral parts of the heating foil element. As stated in the above mentioned U.S. patent, the resistance strip is soldered to intermediate copper foil terminals which in a later strip are soldered to the power leads. To obtain reliable connections these joints are usually made in the factory and the heating elements are consequently delivered with the power leads connected. An obvious drawback with these conventional products is that the combination of the rather delicate heating foil with the rather rigid power leads makes handling difficult. The risk of tearing is also quite high. The length of the attached power leads also often turned out to be either too long or too short.

SUMMARY OF THE INVENTION

The object of the present invention is to improve the previous termination and installation techniques and provide heating foil elements which do not easily tear during handling.

One feature of the present invention is the provision of an electrical heating element which includes an electrical resistance material strip arranged in a predetermined pattern, a sheet of insulation material to which the resistance strip is laminated, a terminal box attached to the insulation sheet and termination elements connected to the resistance strip and extending into the box.

BRIEF DESCRIPTION OF THE DRAWING

The above-mentioned and other features and objects of this invention will clearly appear from the following detailed description of several embodiments of the invention, taken in conjunction with the drawings, where FIG. 1 schematically shows conventional termination of heating foil elements.

SUMMARY OF THE PREFERRED EMBODIMENT

Figure 1:
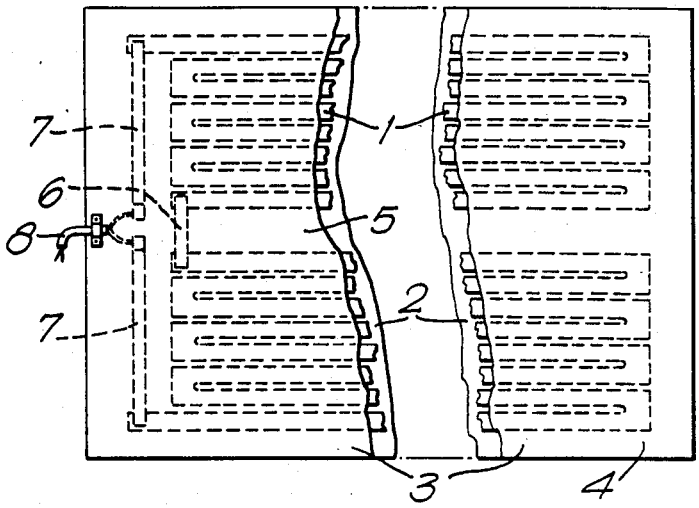

FIG. 1 illustrates a conventional termination of a heating element. A resistance foil strip 1, which extends in windings having meander or zigzag form is surrounded by two layers 2 and 3 of a plastic laminate which is heat-sealable on one side. In order to achieve a satisfactory area load the distance between the longitudinal strips of the windings should be made the minimum dimensions permitted by the insulating requirements. To make room for fastening means such as nails or the like, so that these may be passed through the heating elements with the least possible risk of damaging the resistance foil, relatively broad areas 4 along the edges of the heating element and one or more intermediate areas 5 are chosen in accordance with modules commonly used in buildings.

The resistance foil strip 1 in FIG. 1 is illustrated as two separate parts which are interconnected by a copper strip 6. The resistance foil strip 1 may, however, also consist of one part in which case the area 5 and the strip 6 will be omitted. The other ends of the strip 1 are connected to an electric cable 8 by means of copper terminal strips 7. In order to achieve a good connection and avoid local overheating, it is preferred that some sort of soldering process be used. Apart from having the desired resistivity and flexibility, the foil material should also have a relatively low melting point in order to melt away without causing danger if an accidental short-circuiting should occur if nails or the like penetrate the heating element. To satisfy these requirements, a lead/tin/antimony alloy having a melting point of about 183° C., a thickness of about 0.015 mm and a resistivity of about 0.15 ohm $mm^2/m$ may be used, a melting point of 183° being sufficiently low for the purpose mentioned and at the same time well above the normal operating temperature of the element.

Figure 2:
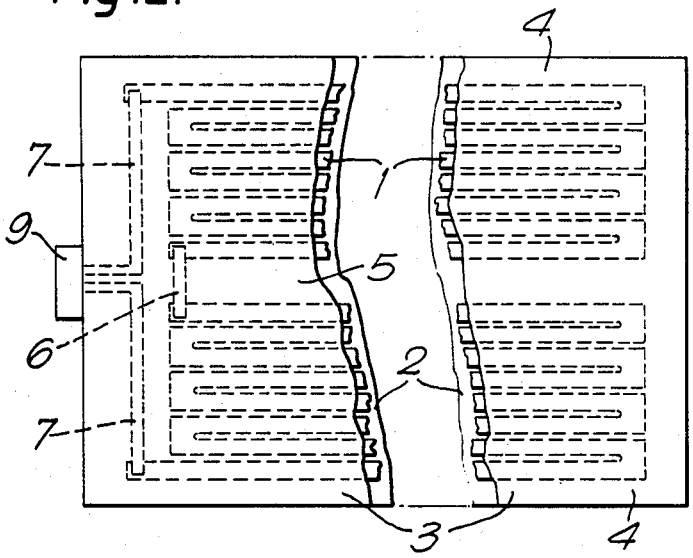
FIG. 2 schematically illustrates the heating foil termination of the present invention.

FIG. 2 illustrates a heating element similar to that shown in FIG. 1, the unique feature being that the termination copper strips or elements 7 are terminated in a box 9 attached directly to the heating element.

Figure 3:
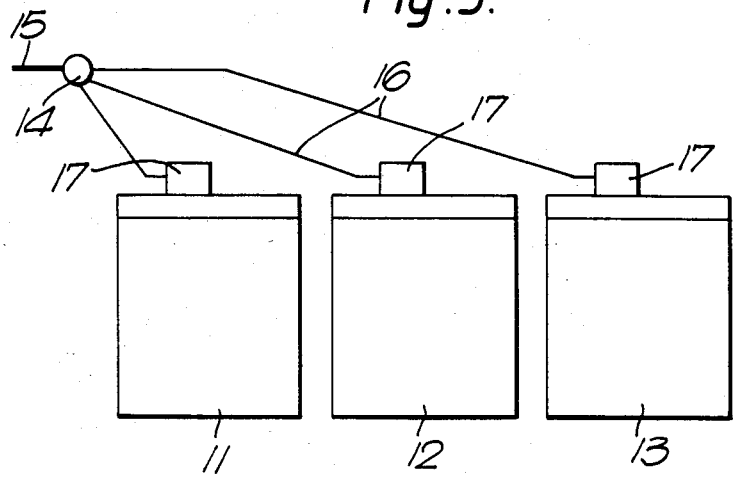
FIGS. 3 and 4 show alternative layouts for connecting a number of heating foil elements to a power line.
Figure 4:
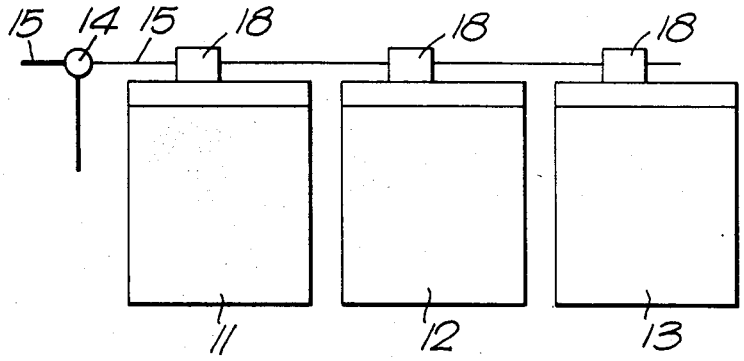

FIG. 3 shows how several heating elements 11, 12 and 13 may be individually connected to an outlet box 14. FIG. 4 shows an alternative arrangement where the elements 11, 12 and 13 are connected in series (or in parallel) with each other to the power supply 14 depending upon the internal connections. The branch circuits 15 and element conductors 16 represent cold leads relative to the heating element resistance foil strip 1. The heating elements are provided with terminal boxes 17 and 18.

Figure 5:
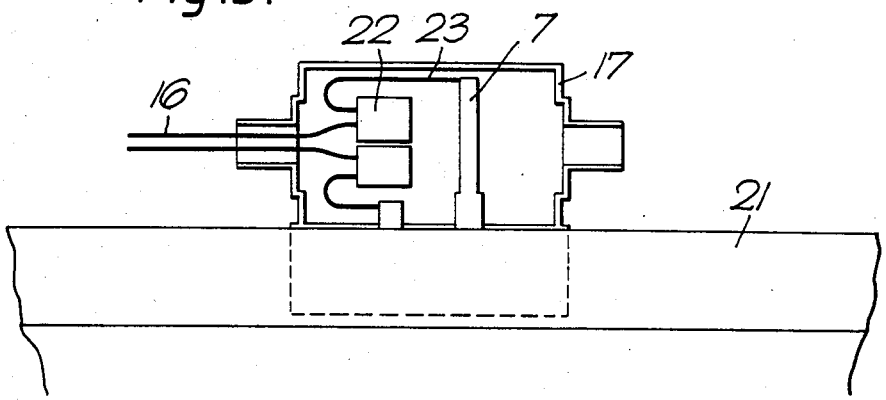
FIGS. 5, 6 and 7 illustrate three alternatives of internal connections between power leads and heating foil termination elements.

FIG. 5 schematically illustrates a heating element to which is attached a terminal box 17 containing two so-called push wire connectors 22. Termination elements (e.g. copper strips) 7 from the heating foil element 21 are connected to the push wire connectors 22 via short leads 23. This type of terminal box 17 may be used for arrangements similar to that illustrated in FIG. 3. Power leads 16 are pushed into the connectors 22 for contact with the heating element 21.

Figure 6:
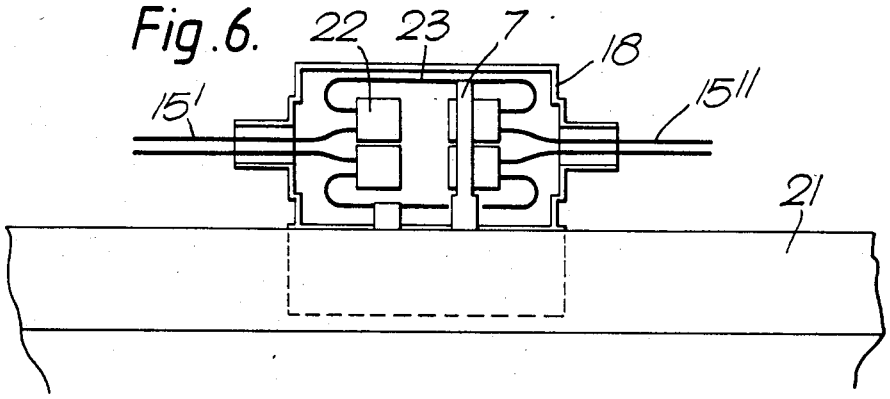
Figure 7:
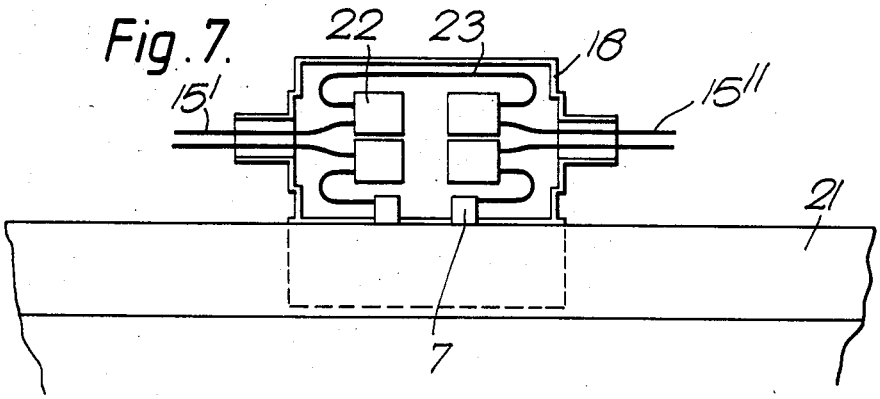

FIGS. 6 and 7 show arrangements like that illustrated in FIG. 4. There are illustrated terminal boxes 18 being provided with four push wire connectors 22 so as to allow parallel or series connection respectively of the heating element. As shown in FIG. 6, the power leads 15' and 15'' are interconnected by means of short leads or straps 23 whereby the heating elements are connected in parallel with the power leads. In FIG. 7 the heating element is shown connected in series with the power leads 15' and 15''.

Figure 8:
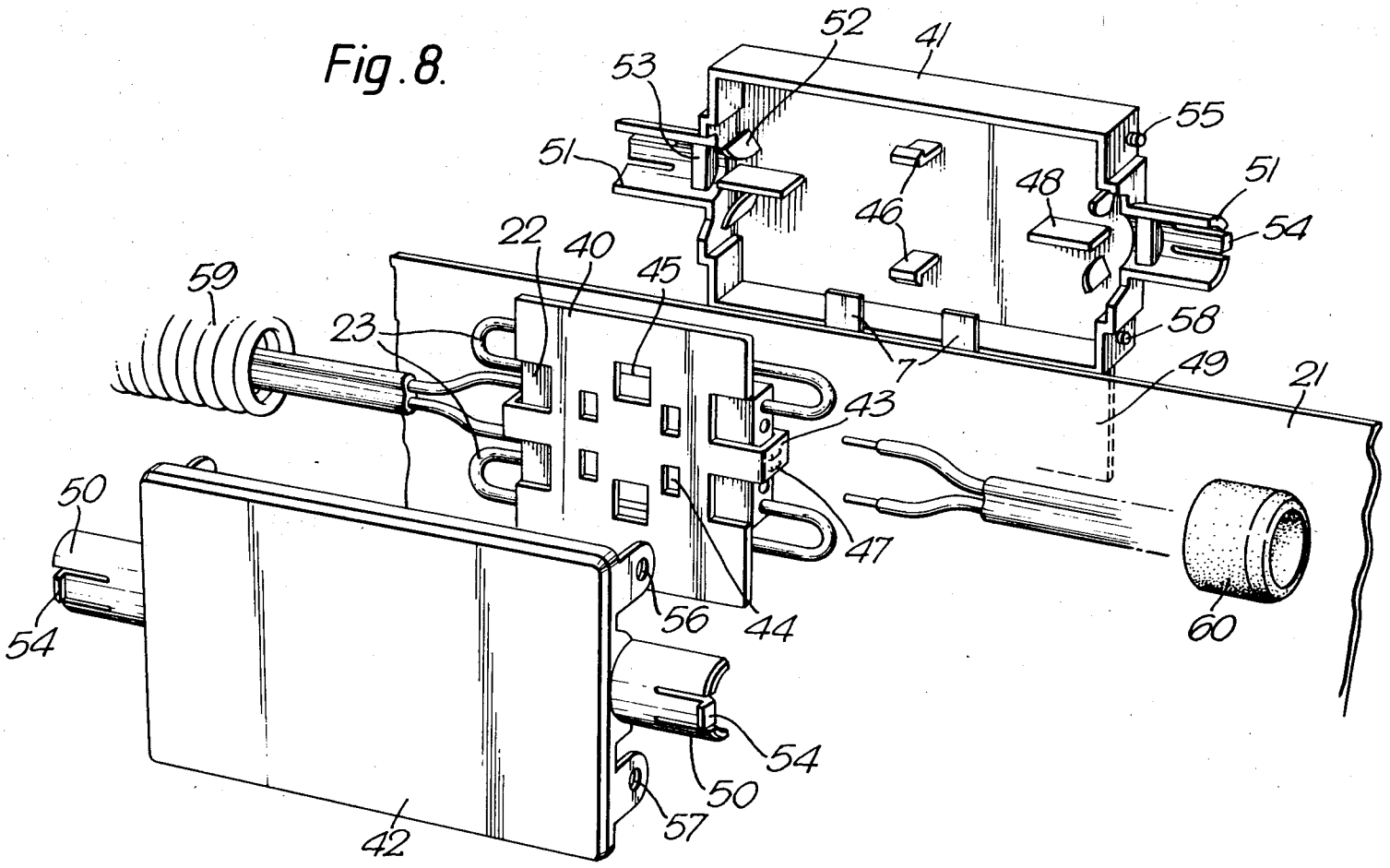
FIG. 8 shows in a somewhat exploded form several details of a terminal box.

In FIG. 8 there is shown, in a somewhat exploded form, more details of the unique terminal box 18 (the terminal box 17 may be built in accordance with the same principles). The box illustrated consists mainly of three parts, namely a board 40, a base plate 41 and a lid 42.

The board 40 may be provided with snap-in holders 43, 44 for the push-wire connectors 22. The board 40 may furthermore be provided with apertures 45 for enabling snapping of the board into the base plate 41. The corresponding snap-in elements of the base plate 41 are illustrated at 46. The board 40 may furthermore be provided with guide pins 47 corresponding to a guide 48 on the base plate 41.

The base plate 41 may be provided with an extended flat brim 49 for facilitating mounting of the terminal box to the heating element 21 by means of taping or gluing. The termination elements 7 of the heating element are indicated. These elements 7 will be soldered to straps 23 as illustrated in FIGS. 6 and 7 before snapping the board 40 into the base plate 41.

For insertion of power leads into the terminal box there may be provided sockets constituted by half-sockets 50 and 51. In the base plate 41, in connection with the guide walls 48, there may be arranged conductor withholding means 52 which are tapered in order to be adaptable to various types of power leads. The sockets 50/51 may also be provided with upper and lower lead strain relieving means 53 for locking the cable or leads within the sockets when the lid is closed. The lid 42 may be detachably hinged to the base plate 41 by means of hinge taps 55 and corresponding apertures 56 in the lid. The lid 42 may also be snapped to the base plate 41 by means of snappers 57, 58. The sockets 50/51 may also be provided with catching means 54 so that when the power leads (a cable as shown or two individual leads) are installed within a tubing 59 this tubing 59 may be inserted over the sockets 50/51 so as to lock the base plate and lid together. There may also be used bushings 60 to make a tight connection between the power leads and the socket. The bushing 60 will also lock the lid to the base plate, and there may be used a closed bushing in one end of the box in the case of an installation as illustrated in FIG. 5.

The details described in connection with FIG. 8 may be varied in a number of ways. The heating element of the present invention may also be built into prefabricated building sections such as wall boards and insulation mats.

Although the power leads and cables are illustrated as being of the non-grounded type, it will be obvious that cables with earth wire may also be used.

The installation procedures will be as follows: In the factory the termination box 17, 18 with push wire connectors 22 and a desirable set of straps 23 are mounted onto the heating foil 21 with the intermediate strips or terminals 7 connected as shown in FIGS. 5–7. The strapped board 40 (FIG. 8) is snapped into the base plate 41 whereupon the heating foil element with terminal box is ready for shipment. The heating unit or units will then be installed at the desired place or places in a ceiling, in wall sections or in a floor without having to bother with attached power leads. Power leads connected to the mains may be installed in the ceiling, wall or floor before or after mounting the heating units. When making connections between the power leads and the heating element the electrician simply has to open the hinged lid 42, push the power leads into contact within the push wire connectors 22, close the lid 42 and push the tubing 59 or bushing 60 required over the box sockets 50/51 to prevent accidental opening of the box. Only in rare cases will the electrician have to make strap changes. This may happen if he needs to change a FIG. 6 type unit into a FIG. 7 type unit.

While I have described the principles of my invention in connection with specific apparatus, it is to be clearly understood that this description is made only by way of example and not as a limitation to the scope of my invention as set forth in the objects thereof and in the accompanying claims.

What is claimed is:

1. An electrical element comprising:

an electrical resistance material strip arranged in a predetermined pattern;

a sheet of insulation material to which said resistance strip is laminated;

a terminal box attached to the insulation sheet, said terminal box including a base, a lid and a socket extending through said box and being formed of two sections, one of said sections joined to said base and the other of said sections joined to said lid;

a board which is detachably mounted in said box;

at least two screwless contacts detachably mounted on said board and receiving power leads which are inserted into said box through said socket for conducting a source of electrical current to said contacts; and termination elements connected to said strip and said contacts.

2. The electrical heating element according to claim 1 wherein said screwless contacts include push wire connectors.

3. The electrical heating element according to claim 1 wherein said socket is provided with a conductor guiding and separation means.

4. The electrical heating element according to claim 5 wherein said conductor guiding and separation means is provided with conductor witholding means.

5. The electrical heating element according to claim 1 wherein said lid has at least one of a detachable or a hinged configuration.

6. The electrical heating element according to claim 1 further comprising securing means placed on said socket sections to lock said lid to said base section.

7. The electrical heating element according to claim 6 wherein said socket further includes catching means for interlocking said socket with said securing means.

* * * * *